US006431968B1

(12) United States Patent
Chen et al.

(10) Patent No.: US 6,431,968 B1
(45) Date of Patent: Aug. 13, 2002

(54) CARRIER HEAD WITH A COMPRESSIBLE FILM

(75) Inventors: Hung Chih Chen, San Jose; Steven M. Zuniga, Soquel, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/296,937

(22) Filed: Apr. 22, 1999

(51) Int. Cl.[7] ..... B24B 47/02
(52) U.S. Cl. ..... 451/398; 451/288
(58) Field of Search ..... 451/41, 59, 63, 451/285, 286, 287, 288, 289, 290, 398, 397

(56) References Cited

U.S. PATENT DOCUMENTS

| | | | | |
|---|---|---|---|---|
| 4,270,316 A | * | 6/1981 | Kramer et al. | |
| 4,918,869 A | | 4/1990 | Kitta | |
| 5,193,316 A | | 3/1993 | Olmstead | |
| 5,205,082 A | | 4/1993 | Shendon et al. | |
| 5,423,716 A | | 6/1995 | Strasbaugh | 451/388 |
| 5,449,316 A | | 9/1995 | Strasbaugh | 451/289 |
| 5,584,751 A | | 12/1996 | Kobayashi et al. | 451/288 |
| 5,624,299 A | | 4/1997 | Shendon | 451/28 |
| 5,643,053 A | | 7/1997 | Shendon | 451/28 |
| 5,643,061 A | | 7/1997 | Jackson et al. | 451/289 |
| 5,759,918 A | * | 6/1998 | Hoshizaki et al. | 438/692 |
| 5,803,799 A | | 9/1998 | Volodarsky et al. | 451/288 |
| 5,851,140 A | * | 12/1998 | Barns et al. | 451/288 |
| 5,879,220 A | | 3/1999 | Hasegawa et al. | 451/288 |
| 5,957,751 A | | 9/1999 | Govzman et al. | 451/8 |
| 5,964,646 A | * | 10/1999 | Kassir et al. | 451/41 |
| 5,964,653 A | | 10/1999 | Perlov et al. | 451/288 |
| 6,012,964 A | * | 1/2000 | Arai et al. | 451/5 |
| 6,083,090 A | * | 7/2000 | Bamba | 451/288 |
| 6,102,788 A | * | 8/2000 | Uto | 451/388 |
| 6,113,468 A | * | 9/2000 | Natalicio | 451/41 |

FOREIGN PATENT DOCUMENTS

| | | |
|---|---|---|
| EP | 0 841 123 A1 | 5/1998 |
| JP | 2243263 | 9/1990 |
| WO | WO 99/07516 | 2/1999 |

* cited by examiner

*Primary Examiner*—Timothy V. Eley
(74) *Attorney, Agent, or Firm*—Fish & Richardson

(57) ABSTRACT

A carrier head for a chemical mechanical polishing apparatus has a base, a first flexible membrane extending beneath the base to form a first pressurizable chamber, a support structure positioned in the first chamber, and a compressible film adjacent a bottom surface of the support structure. A lower surface of the first flexible membrane providing a mounting surface for a substrate. The compressible film has a plurality of apertures disposed in a pattern to establish a pressure distribution on a top surface of the first flexible membrane.

12 Claims, 5 Drawing Sheets

CARRIER HEAD WITH A COMPRESSIBLE FILM

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is non-uniform polishing, i.e., the tendency of some portions of the substrate to be polished at a different rate than other portions of the substrate. This non-uniform polishing may occur even if pressure is applied uniformly to the substrate.

SUMMARY

In one aspect, the invention is directed to a carrier head having a base, a first flexible membrane extending beneath the base to form a first pressurizable chamber, a support structure positioned in the first chamber, and a compressible film adjacent a bottom surface of the support structure. A lower surface of the first flexible membrane providing a mounting surface for a substrate. The compressible film has a plurality of apertures disposed in a pattern to establish a pressure distribution on a top surface of the first flexible membrane.

Implementations of the invention may include the following features. The pattern of the plurality of apertures may be selected to provide a non-uniform pressure distribution that improves polishing uniformity. The apertures may be disposed in a generally symmetric pattern, and may be less than about one-half inch in diameter. A second pressurizable chamber formed by a second flexible membrane may apply a downward pressure to the support structure.

In another aspect, the invention is directed to a carrier head having a base, a flexible membrane extending beneath the base and providing a mounting surface for a substrate, a support structure between the base and the flexible membrane, and a compressible film between the support structure and the flexible membrane. The compressible film includes a plurality of apertures to establish a pressure distribution across a surface of the substrate.

In another aspect, the invention is directed to a carrier head having a housing, a rigid structure movably connected to the housing, and a compressible film positioned on a bottom surface of the rigid structure. The compressible film has a plurality of apertures disposed in a pattern to create a pressure distribution across a surface of a substrate during polishing.

In another aspect, the invention is directed to a carrier head having a housing, a rigid structure movably connected to the housing, a plurality of indentations formed in a bottom surface of the rigid structure, and a compressible film positioned on the bottom surface of the rigid structure. The indentations in the rigid structure are disposed in a pattern to create a pressure distribution across a surface of a substrate during polishing.

In another aspect, the invention is directed to a carrier head having a housing, a rigid structure movably connected to the housing, and a compressible film positioned on a bottom surface of the rigid structure. The compressible film includes a plurality of regions of different compressibility. The regions of different compressibility are disposed in a pattern to create a pressure distribution across a surface of a substrate during polishing.

Implementations of the previous three embodiments may include the following. The carrier head may have a flexible membrane with a substrate receiving surface. The film may be positioned between the rigid structure and the flexible membrane.

In another aspect, the invention is directed to a compressible film that is detachably securable to a surface of a rigid structure in the carrier head. The compressible film has a plurality of apertures positioned to create a non-uniform pressure distribution on a substrate during polishing so as to improve polishing uniformity.

In another aspect, the invention is directed to a kit that has a carrier head with a housing and a rigid structure movably connected to the housing, and a plurality of compressible films detachably securable to a bottom surface of the rigid structure. Each compressible film has a plurality of apertures to create a non-uniform pressure distribution on a substrate during polishing. At least two of the compressible films have apertures disposed in different patterns to create different pressure distributions on the substrate.

In another aspect, the invention is directed to a carrier head that has a housing, a rigid structure movably connected to the housing, a compressible film secured to a surface of the rigid structure for transferring pressure to a substrate during polishing, and means for creating a non-uniform pressure distribution on the substrate from the compressible film.

Advantages of the invention may include the following. A non-uniform pressure can be applied to the back surface of the substrate to compensate for non-uniform polishing rates. Non-uniform polishing of the substrate is thereby reduced, and the resulting flatness and finish of the substrate are improved. A carrier head can easily be modified to provide different pressure distributions on the substrates.

Other advantages and features of the invention will be apparent from the following description, including the drawings and claims.

BRIEF DESCRIPTION OF THE DRAWINGS

Like reference numbers are designated in the various drawings to indicate like elements. A primed reference number or a reference number with a letter suffix indicates that an element has a modified function, operation or structure.

DETAILED DESCRIPTION

Figure 1:
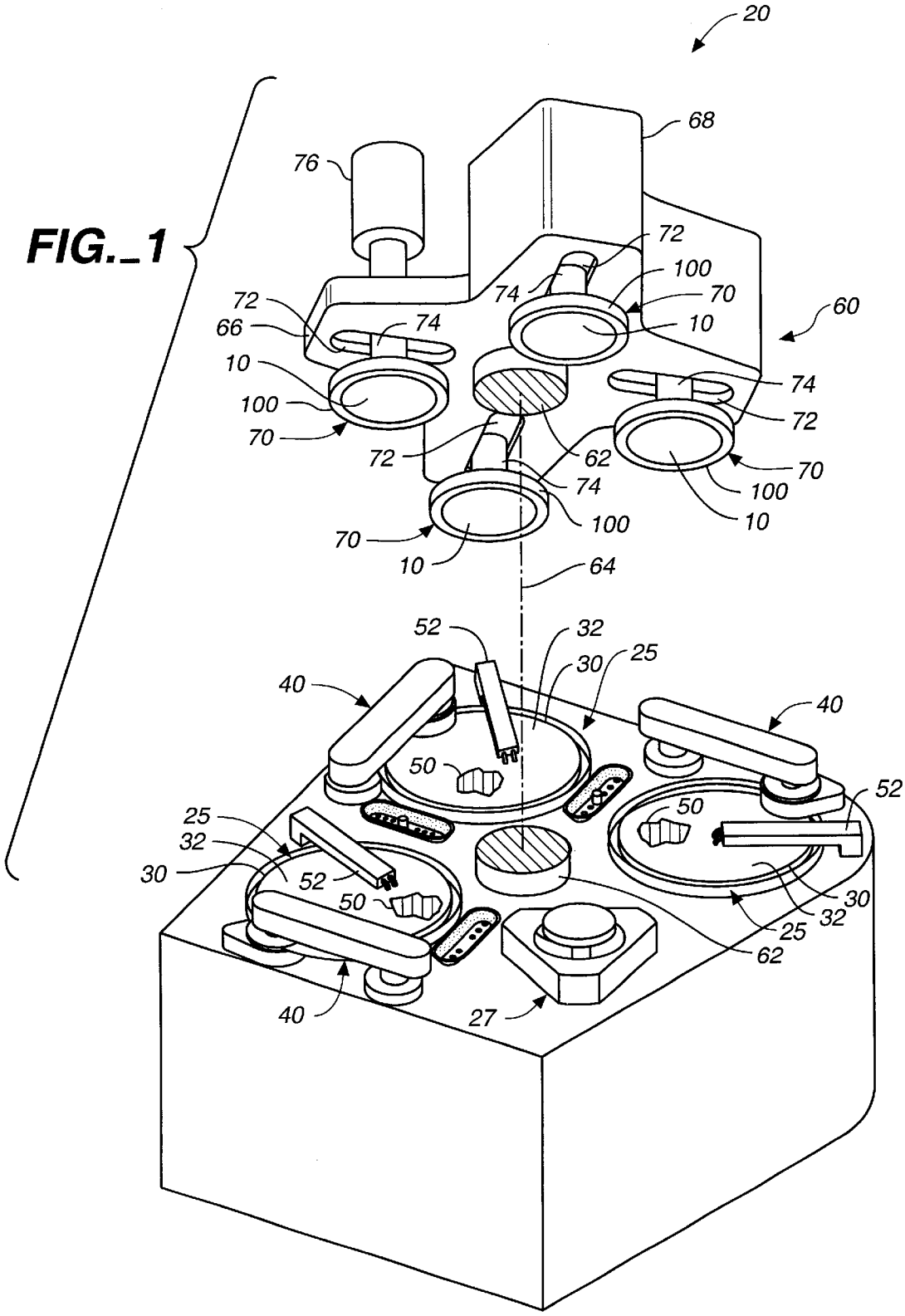
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing pad 32. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. Each motor and drive shaft may be supported on a slider (not shown) which can be linearly driven along the slot by a radial drive motor to laterally oscillate the carrier head.

During polishing, three of the carrier heads are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
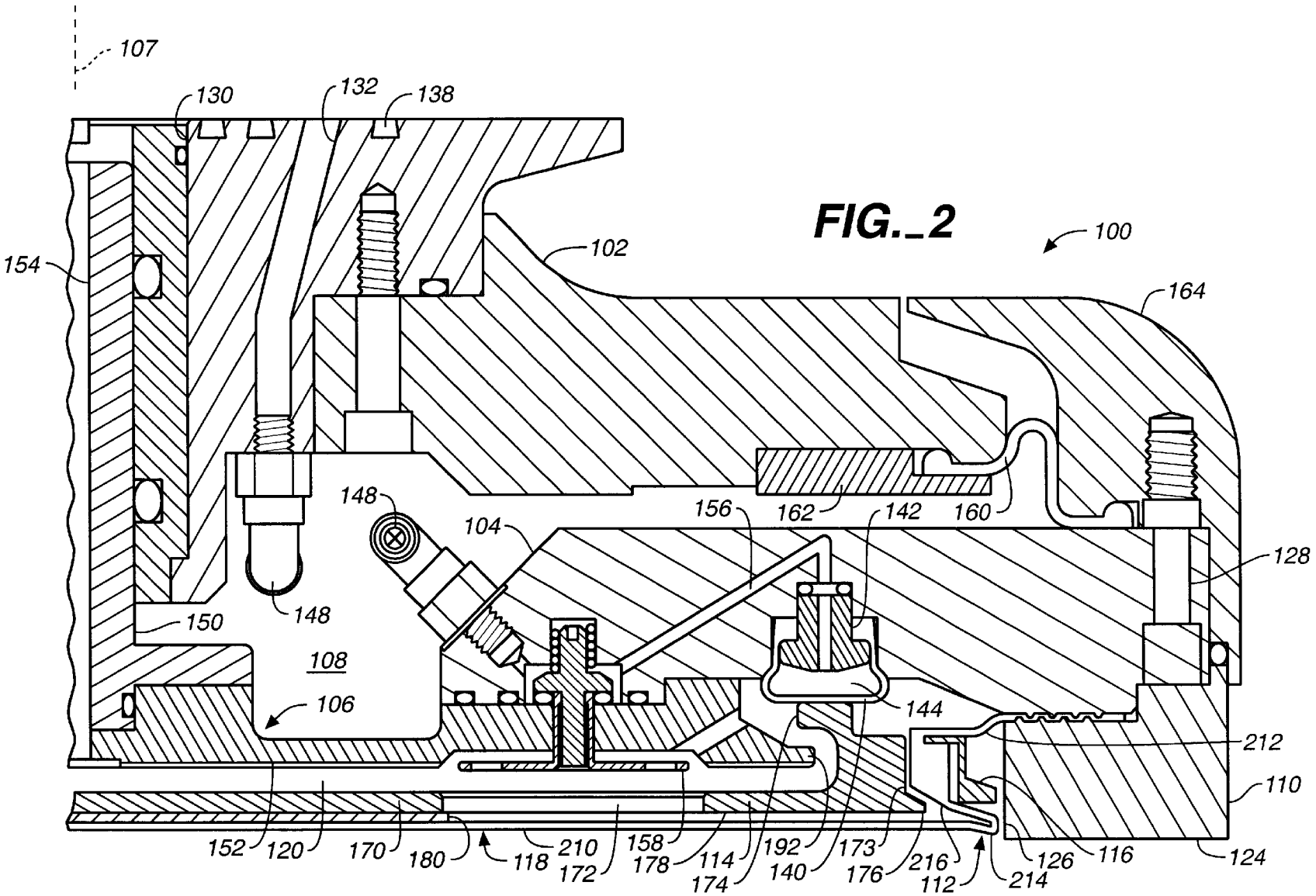
FIG. 2 is a schematic cross-sectional view of a carrier head according to the present invention.

Referring to FIG. 2, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/745,670 by Zuniga, et al., filed Nov. 8, 1996, entitled A CARRIER HEAD WITH A FLEXIBLE MEMBRANE FOR A CHEMICAL MECHANICAL POLISHING SYSTEM, and assigned to the assignee of the present invention, the entire disclosure of which is incorporated herein by reference. Only the right half of the carrier head is illustrated in FIG. 2. The left half of the carrier head is generally symmetric to the right half, although it does not include the substrate sensing valve discussed below.

Housing 102 can be connected to drive shaft 74 to rotate therewith during polishing about an axis of rotation 107 which is substantially perpendicular to the surface of the polishing pad during polishing. Housing 102 may be generally circular in shape to correspond to the circular configuration of the substrate to be polished. A vertical bore 130 may be formed through the housing, and two passages (only one passage 132 is shown) may extend through the housing for pneumatic control of the carrier head. O-rings 138 may be used to form fluid-tight seals between the passages through the housing and passages through the drive shaft.

Base 104 is a generally rigid ring-shaped or diskshaped body located beneath housing 102. An elastic and flexible membrane 140 may be attached to the lower surface of base 104 by a clamp ring 142 to define a bladder 144. Clamp ring 142 may be secured to base 104, e.g., by unillustrated screws or bolts. A passage 156 may extend through the clamp ring and the base, and two fixtures 148 may provide attachment points to connect a flexible tube between housing 102 and base 104 to fluidly couple passage 132 to bladder 144. In addition, a valve 158 may connect passage 156 to a chamber 120 below base 104. Valve 158 may be used to sense the presence of a substrate, as described in U.S. application Ser. No. 08/862,350, by Boris Govzman et al., filed May 23, 1997, entitled A CARRIER HEAD WITH A SUBSTRATE DETECTION SYSTEM FOR A CHEMICAL MECHANICAL POLISHING SYSTEM, and assigned to the assignee of the present invention, the entire disclosure of which is incorporated herein by reference. A first pump (not shown) may be connected to bladder 144 to direct a fluid, e.g., a gas, such as air, into or out of the bladder.

Gimbal mechanism 106, which may be considered to be part of base 104, permits the base to pivot with respect to housing 102 so that the base may remain substantially parallel with the surface of the polishing pad. Gimbal mechanism 106 includes a gimbal rod 150 which fits into vertical bore 130 and a flexure ring 152 which is secured to base 104. Gimbal rod 150 may slide vertically along bore 130 to provide vertical motion of base 104, but it prevents any lateral motion of base 104 with respect to housing 102. Gimbal rod 150 may include a passage 154 that extends the length of the gimbal rod and provides fluid communication with chamber 120.

An inner edge of a generally ring-shaped rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. A second pump (not shown) may be fluidly connected to loading chamber 108 by an unillustrated passage in the housing to control the pressure in the loading chamber and the load applied to base 104. The vertical position of base 104 relative to polishing pad 32 is also controlled by loading chamber 108.

Retaining ring 110 may be a generally annular ring secured at the outer edge of base 104, e.g., by bolts 128. When a fluid is pumped into loading chamber 108 and base 104 is pushed downwardly, retaining ring 110 is also pushed downwardly to apply a load to polishing pad 32. A bottom surface 124 of retaining ring 110 may be substantially flat, or it may have a plurality of channels to facilitate transport of slurry from outside the retaining ring to the substrate. An inner surface 126 of retaining ring 110 engages the substrate to prevent it from escaping from beneath the carrier head.

Substrate backing assembly 112 includes a support structure 114, a flexible member or membrane 118, and a spacer ring 116. Flexible membrane 118 is a generally circular sheet formed of a flexible and elastic material. A central portion 210 of flexible membrane 118 extends below support structure 114 to provide a mounting surface 122 for a substrate. A perimeter portion 212 of the flexible membrane extends between support structure 114 and spacer ring 116 to be secured to the carrier head, e.g., to base 104 or retaining ring 110. The sealed volume between flexible membrane 118 and base 104 defines pressurizable chamber 120. A third pump (not shown) may be fluidly connected to chamber 120 by passage 154 to control the pressure in chamber 120 and thus the downward force of the mounting surface on the substrate. In addition, chamber 120 may be evacuated to pull flexible membrane 118 upwardly and thereby vacuum-chuck the substrate to the carrier head. The perimeter portion 212 of the flexible membrane includes a relatively thick portion 216 located between support structure 114 and spacer ring 116, and a flap portion 214 located at the edge of center portion 210. When chamber 120 is evacuated, flap portion 214 may be pulled against substrate 10 to form a seal and improve the vacuum-chucking of the substrate, as described in U.S. patent application Ser. No. 09/149,806 by Zuniga, et al., filed Aug. 31, 1998, entitled A CARRIER HEAD FOR CHEMICAL MECHANICAL POLISHING, and assigned to the assignee of the present invention, the entire disclosure of which is incorporated herein by reference.

Spacer ring 116 is a generally annular member positioned between retaining ring 110 and support structure 114. Specifically, spacer ring 116 may be located above a flap portion of flexible membrane 118.

Support structure 114 is located inside chamber 120 to provide a support for the substrate during substrate chucking, to limit the upward motion of the substrate and flexible membrane when chamber 120 is evacuated, to maintain the desired shape of flexible membrane 118, and to apply additional pressure to the substrate in localized areas during polishing. Specifically, support structure 114 may be a generally rigid member having a disk-shaped plate portion 170 and a generally annular flange portion 174 that extends upwardly from plate 170. An aperture 172 permits the flexible membrane to extend through plate 170 to activate valve 158. In addition, a plurality of unillustrated apertures are formed through the plate portion to provide fluid flow between the portions of chamber 120 above and below support structure 114. These unillustrated apertures may be located near a rim 173 of plate 170. In addition, plate 170 may have a outwardly-projecting lip 176 at its outer edge. Support structure 114 may be "free-floating", i.e., not secured to the rest of the carrier head, and may be held in place by the flexible membrane.

Flange 174 extends over a ledge 192 the projects from base 104. When polishing is complete and loading chamber 108 is evacuated to lift base 104 away from the polishing pad, and chamber 120 is either pressurized or vented, the lower surface of flange 174 engages ledge 192 to act as a hard stop that limits the downward motion of support structure 114 and prevents overextension of the flexible membrane.

Figure 3:
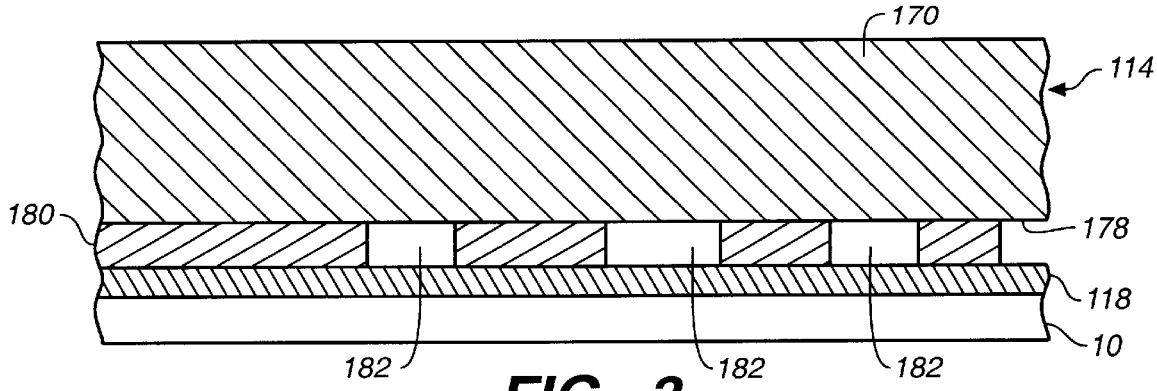
FIGS. 3 and 4 are enlarged and perspective views, respectively, of a backing film of the carrier head of FIG. 2.
Figure 4:
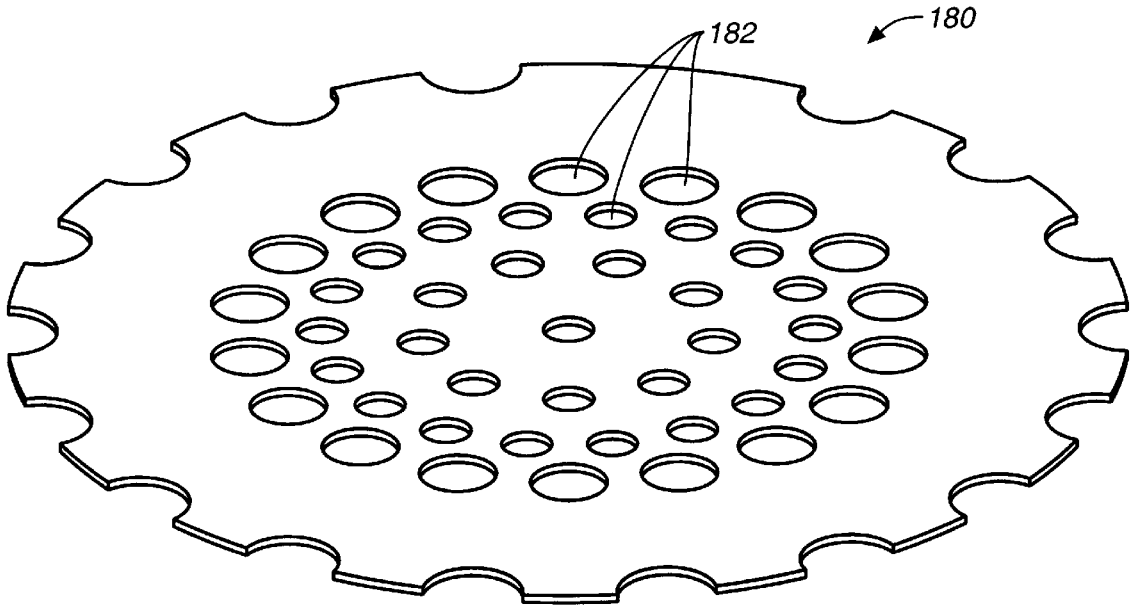

Referring to FIGS. 3 and 4, a compressible backing film 180 is attached to a bottom surface 178 of plate 170. Backing film 180 is a thin sheet formed of a compressible material, e.g., a carrier film such as DF200, available from Rodel, Inc., of Newark, Del. The backing material may be about 25 mils thick. A layer of adhesive can secure the backing film to plate 170. The backing film can be a generally circular film secured to a region of the plate having a generally planar bottom surface, e.g., interior to the region of the plate with the apertures.

Bladder 144 may be used to apply a downward force to support structure 114 so that backing film 180 directly contacts a top surface of flexible membrane 118 to preferentially apply pressure to selected areas of the substrate, as discussed in U.S. application Ser. No. 08/907,810, by Steven M. Zuniga, et al., filed Aug. 8, 1997, entitled A CARRIER HEAD WITH LOCAL PRESSURE CONTROL FOR A CHEMICAL MECHANICAL POLISHING APPARATUS, and assigned to the assignee of the present invention, the entire disclosure of which is incorporated herein by reference.

The backing film is "patterned" to provide a desired pressure distribution or profile on the top surface of the flexible membrane when the bladder presses downwardly on the support structure. Specifically, a plurality of holes or apertures 182 are formed through the backing film. By appropriately selecting the spacing and size of the apertures in the backing film, an area of increased pressure on the substrate may be provided to optimize polishing performance. The backing film also provides a region of soft contact for the flexible membrane to prevent damage to the substrate.

Figure 5A:
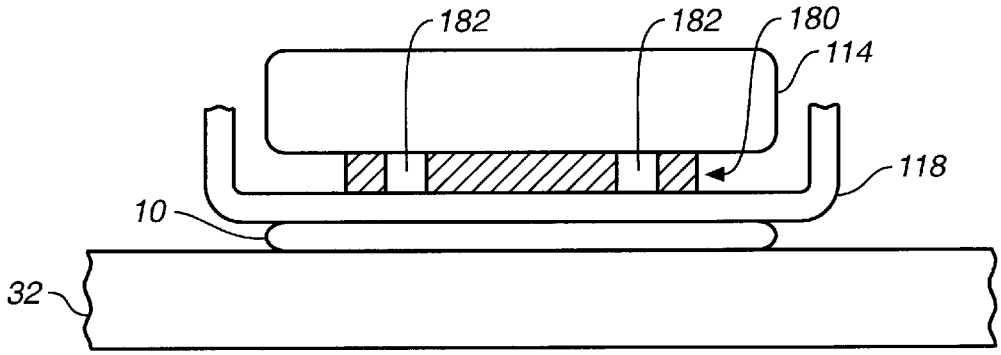
FIG. 5A is a diagrammatic cross-sectional view illustrating a support structure, backing film and a flexible membrane.
Figure 5B:
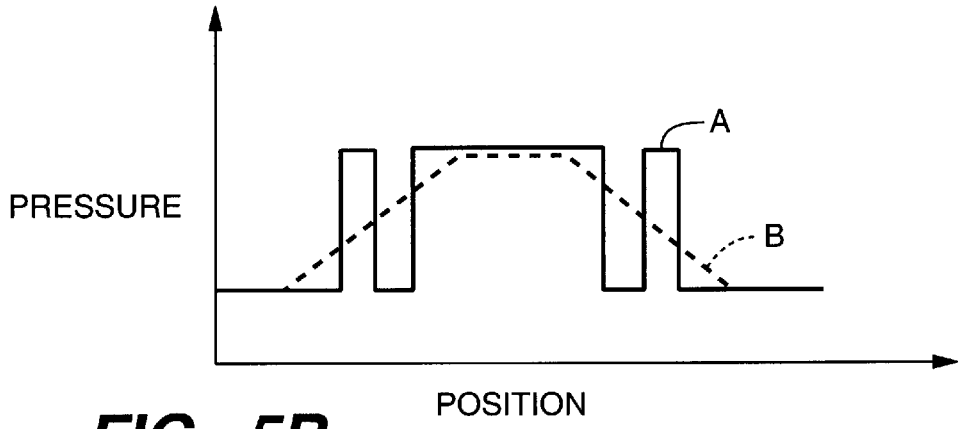
FIG. 5B is a graph of the pressure distribution at the front and back surfaces of the substrate resulting from use of the carrier head of FIG. 2.

As shown by FIGS. 5A and 5B, when the bladder applies a downward force on support structure 114, the portions of backing film 180 which contact the top surface of the flexible membrane will apply a discrete pressure distribution against the top surface of flexible membrane 118 (the profile of this pressure distribution is shown by solid line A). However, this pressure will be distributed and spread out by the backing film, the flexible membrane, and the substrate itself, to provide a relatively smooth pressure distribution at the front surface of the substrate (the profile of this pressure distribution is shown by phantom line B). The size and position of apertures 182 are selected to provide a desired pressure distribution. For example, by spacing the apertures closer together or by making them larger, relatively less pressure will be applied to the substrate. On the other hand, by spacing the apertures further apart or by making them smaller, relatively more pressure will be applied to the substrate. If the apertures are reasonably uniformly spaced and have a diameter less than a critical diameter, the pressure will be effectively distributed across the substrate front surface. This distribution of pressure generates a pressure distribution that is locally uniform, i.e., generally uniform over the region of an individual aperture, but globally non-uniform, i.e., varying across the substrate. For the backing film discussed above, the critical diameter appears to be about ½ inch, although this will depend on the polishing parameters and the composition of the membrane, backing film, substrate, and polishing pad. The apertures may be less than the critical diameter to provide a pressure distribution that is locally uniform but globally non-uniform.

As noted, the patterned backing film may be designed to compensate for polishing non-uniformities. For example, if a certain polishing process results in substrates that are underpolished near the substrate center, the backing film can be patterned with fewer apertures near the center of the film, thereby generating a region of increased pressure at the substrate center. This increases the polishing rate at the substrate center so that it matches the polishing rate in other regions of the substrate, thereby substantially improving polishing uniformity. The apertures may form a generally radially symmetric pattern across the backing film.

In operation, fluid is pumped into chamber 120 to control the downward pressure applied to the substrate by flexible membrane 118. In addition, bladder 144 is inflated to contact flange 174 and exert a downward pressure on support structure 114. Thus, backing film 180 is pressed against the top surface of the flexible membrane to locally increase the pressure on the substrate and compensate for non-uniform polishing as necessary.

An advantage of this configuration is that a variety of backing films with different aperture patterns can be fabricated and used. To modify the pressure distribution generated by the support structure, one backing film is simply removed from the support structure and another is attached. Backing films with different aperture patterns may be packaged in a kit.

Figure 6:
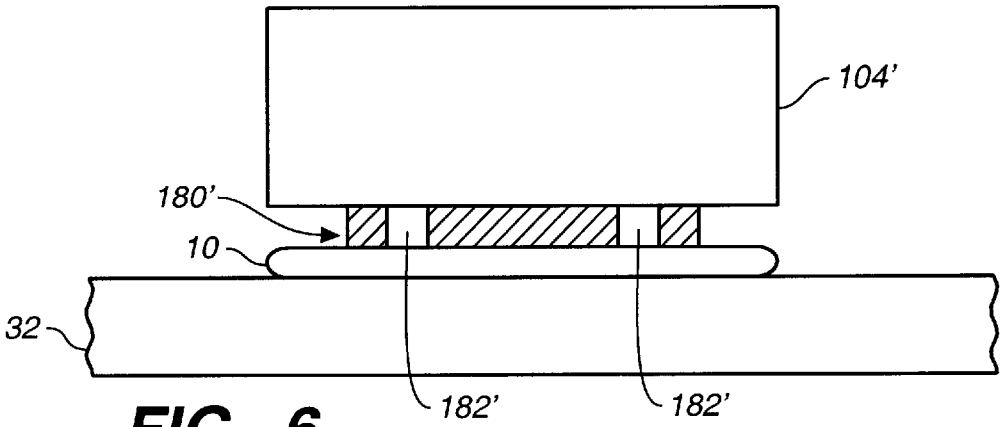
FIG. 6 is a diagrammatic cross-sectional view of a carrier head in which the backing film directly contacts a substrate.

Referring to FIG. 6, in another implementation, a compressible backing film 180' is attached to the underside of a rigid carrier base 104'. Backing film 180' directly contacts the backside of substrate 10 to apply force to the substrate. The backing film compensates for small surface imperfections in the substrate or carrier base. In addition, the substrate itself acts as a buffer to smooth out the pressure distribution created by the backing film. The backing film can be patterned to provide a desired pressure distribution at the front surface of the substrate.

Figure 7A:
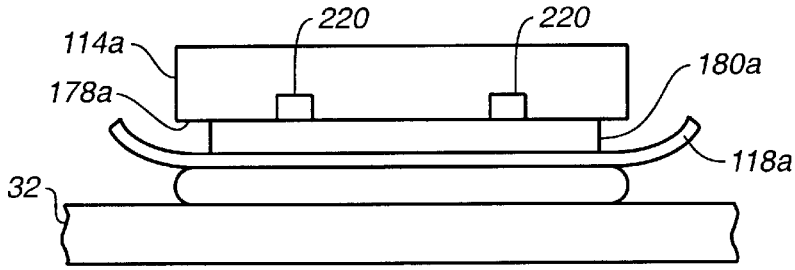
FIGS. 7A and 7B are diagrammatic cross-sectional views of a carrier head that includes a backing film and a patterned support structure or base with indentations, respectfully.

Referring to FIG. 7A, in another implementation, a bottom surface 178*a* of a support structure 114*a* is provided with indentations 220. In this implementation, backing film 180*a* does not necessarily include apertures. Support structure 114*a* does not apply pressure to the backing film in the regions of indentations 220. However, the pressure from support structure 114*a* is redistributed by the backing film and substrate to create a relatively smooth pressure distribution at the front surface of the substrate. In addition, the pattern of indentations 220 in support structure 114*a* can be selected to provide a desired pressure distribution at the front surface of the substrate and thereby improve polishing uniformity.

Figure 7B:
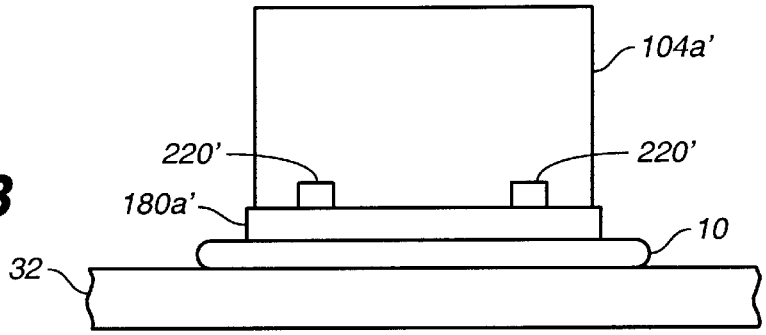

Referring to FIG. 7B, if backing film 180*a'* directly contacts the top surface of substrate 10, indentations 220' can be formed in a bottom surface 178*a'* of carrier base 104*a'* to provide a similar effect.

Figure 8A:
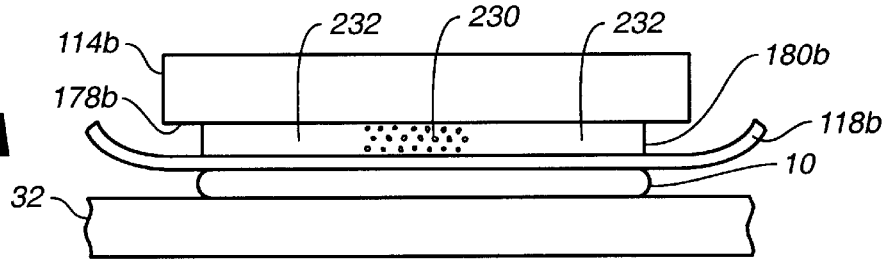
FIGS. 8A and 8B are diagrammatic cross-sectional views of a carrier head that includes a backing film with regions of different compressibility.

Referring to FIG. 8A, in another implementation, backing film 180*b* includes high compressibility regions 230 and low compressibility regions 232. More pressure is transferred to the substrate backside in the high compressibility regions than in the low compressibility regions, thereby creating a non-uniform pressure distribution. The pressure is from support structure 114*b* redistributed by flexible membrane 118*b* and substrate 10 to create a relatively smooth pressure distribution at the front surface of the substrate. In addition, the pattern of high and low compressibility regions 230 and 232 in backing film 180*b* can be selected to provide a desired pressure distribution at the front surface of the substrate and thereby improve polishing uniformity.

Figure 8B:
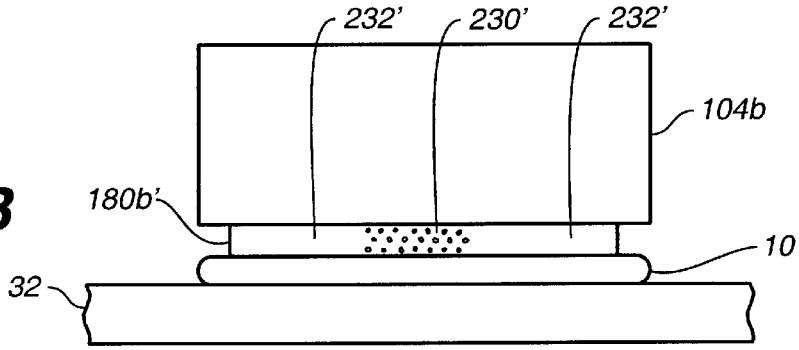

Referring to FIG. 8B, if backing film 180*b'* directly contacts the top surface of substrate 10, high and low compressibility regions 230' and 232' provide a similar effect.

The present invention has been described in terms of a number of embodiments. The invention, however, is not limited to the embodiments depicted and described. Rather, the scope of the invention is defined by the appended claims.

What is claimed is:

1. A carrier head, comprising:

a base;

a first flexible membrane extending beneath the base to form a first pressurizable chamber, a lower surface of the first flexible membrane providing a mounting surface for a substrate;

a support structure positioned in the first chamber; and a compressible film adjacent a bottom surface of the support structure, the compressible film having a plurality of apertures disposed in a pattern to establish a pressure distribution on a top surface of the first flexible membrane.

2. The carrier head of claim 1, wherein the pattern of the plurality of apertures is selected to provide a non-uniform pressure distribution that improves polishing uniformity during polishing.

3. The carrier head of claim 1, wherein the apertures are disposed in a generally symmetric pattern.

4. The carrier head of claim 1, wherein the apertures are spaced and positioned to provide a pressure distribution on the substrate that is locally uniform but globally non-uniform.

5. The carrier head of claim 4, wherein the apertures are less than about one-half inch in diameter.

6. The carrier head of claim 1, further comprising a second pressurizable chamber to apply a downward pressure to the support structure.

7. A carrier head, comprising:

a base;

a flexible membrane extending beneath the base and providing a mounting surface for a substrate;

a support structure between the base and the flexible membrane; and a compressible film between the support structure and the flexible membrane, the compressible film including a plurality of apertures to establish a pressure distribution across a surface of the substrate.

8. A carrier head, comprising:

a housing;

a rigid structure movably connected to the housing; and a compressible film positioned on a bottom surface of the rigid structure, the compressible film having a plurality of apertures disposed in a pattern to create a pressure distribution across a surface of a substrate during polishing.

9. The carrier head of claim 8, further comprising a flexible membrane having a substrate receiving surface, wherein the film is positioned between the rigid structure and the flexible membrane.

10. A kit comprising:

a carrier head including a housing and a rigid structure movably connected to the housing; and a plurality of compressible films detachably securable to a bottom surface of the rigid structure, each compressible film having a plurality of apertures to create a non-uniform pressure distribution on a substrate during polishing, wherein at least two of the compressible films have apertures disposed in different patterns to create different pressure distributions on the substrate.

11. A carrier head, comprising:

a housing;

a rigid structure movably connected to the housing;

a compressible film secured to a surface of the rigid structure for transferring pressure to a substrate during polishing; and aperture means formed in the compressible film for creating a non-uniform pressure distribution on the substrate during polishing.

12. A carrier head for chemical mechanical polishing of a substrate comprising:

a base;

a first flexible membrane extending beneath the base to form a first pressurizable chamber, a lower surface of the first flexible membrane providing a mounting surface for a substrate;

a support structure positioned in the first chamber;

a compressible film adjacent a bottom surface of the support structure, the compressible film having a plurality of apertures disposed in a pattern to establish a pressure distribution on a top surface of the first flexible membrane; and a second pressurizable chamber to apply a pressure to the support structure, wherein the second pressurizable chamber is formed by a second flexible membrane.

* * * * *